United States Patent [19]

Uchimura et al.

[11] Patent Number: 4,982,946

[45] Date of Patent: Jan. 8, 1991

[54] APPARATUS FOR TRANSPORTING PAPER

[75] Inventors: Mitsuo Uchimura; Seiji Koike; Osamu Koizumi; Takeshi Tashiro; Kazuhiro Fushimi, all of Shizuoka; Ikuzo Sugiura, Kanagawa, all of Japan

[73] Assignee: Tokyo Electric Co., Ltd., Tokyo, Japan

[21] Appl. No.: 477,479

[22] Filed: Feb. 9, 1990

[30] Foreign Application Priority Data

Feb. 16, 1989 [JP] Japan ..... 1-37043

[51] Int. Cl.[5] ..... B65H 9/16

[52] U.S. Cl. ..... 271/251; 226/190; 271/274

[58] Field of Search ..... 271/251, 274; 226/190, 226/194

[56] References Cited

U.S. PATENT DOCUMENTS 4,605,218 8/1986 Knepper ..... 271/251 X
4,625,958 12/1986 Dyma ..... 271/274
4,836,527 6/1989 Wong ..... 271/251

FOREIGN PATENT DOCUMENTS 61-266277 11/1986 Japan .

*Primary Examiner*—Richard A. Schacher
*Attorney, Agent, or Firm*—Oblon, Spivak, McClelland, Maier & Neustadt

[57] ABSTRACT

An apparatus for transporting paper comprising a paper transport path made up of a reference surface with which one edge portion of paper is brought into abutment and a paper guide on which the surface of the paper is supported, a skew roller supported on a roller shaft, which is arranged at an angle with the transport direction of the paper, and resilently urged toward the paper guide, a skew roller portions control having an abutment surface with which one end portion of the roller shaft is brought into abutment when the skew roller takes a position to be in contact with the paper and a stopper edge with which the periphery of the roller shaft is brought into abutment when the skew roller takes an open position to be away from the paper and being urged toward the skew roller, and a release to move the skew roller position control away from the skew roller, whereby it is made possible to simply bring about a state of the skew roller separated from the paper guide and a state of them held in contact.

3 Claims, 6 Drawing Sheets

APPARATUS FOR TRANSPORTING PAPER

FIELD OF THE INVENTION AND RELATED ART STATEMENT

The present invention relates to a printer or the like using a long sheet of paper and, more particularly, relates to an apparatus for transporting paper provided with a skew roller used for keeping the lateral position of the transported paper correct.

As methods for positioning paper with respect to the printing head in a printer, there are, in general, two ways: one way to set paper such that the center of the paper comes in the center of the printing head and the other way to set paper such that one edge of the paper is pushed against a reference surface located toward one end of the printing head.

In the paper feeding system using the latter method, it is generally practiced to arrange a roller at an angle with the advancing direction of the paper so that the paper is always pushed against the reference surface.

A prior art example of such an apparatus will be described below with reference to FIG. 9 and FIG. 10. There is provided a paper guide 1 adapted such that paper is held in contact with the underside thereof. The paper guide 1 is provided at its one side with a side plate 3 having a reference surface 2 formed thereon, against which the side edge of the paper is intended to abut. Below the paper guide 1 is provided a mount 4, a predetermined distance apart therefrom. On the mount 4, there is fixed a fulcrum shaft 5, and a mounting plate 7 is supported on this fulcrum shaft 5 for rotation, urged by a push-up spring 6 upwardly. At the end of the mounting plate 7, there is fixed a roller shaft 8 at a predetermined angle with the transported direction of the paper, and on this roller shaft 8, a pair of skew roller 9 are supported for rotation, with their outer ends provided with stop rings 10 for preventing the rollers from coming off the shaft in the axial direction.

With the described arrangement, when paper is transported, the paper pushed by the skew rollers 9 receives a component force in the direction in which it abuts against the reference surface 2 of the side plate 3. As a result, the paper is transported referenced from the reference surface 2 at all times, whereby it is prevented from suffering from such adverse effects as to cause the paper to make meandering movement.

The roller shaft 8 is prolonged and both ends thereof sticking out are designed to serve as portions to operate the roller. More particularly, when new paper is to be set into the apparatus, if the skew rollers 9 are held pressed against the paper guide 1, the paper cannot be inserted therebetween, and therefore, the end of the roller shaft 8 is gripped and pushed down to obtain an empty space between the skew rollers 9 and the paper guide 1 so that the paper can be inserted therein.

With such a prior art structure, when paper is to be set therein, the operation must be performed with the roller shaft 8 pressed down with one hand as described above, and hence, there is a problem that operability of the apparatus is very poor. When inserting narrow paper, in particular, it is difficult to push the paper into the position where it abuts against the reference surface.

OBJECT AND SUMMARY OF THE INVENTION

A first object of the present invention is to make setting of paper in a long sheet form easy.

A second object of the present invention is to bring about a state where the skew rollers are separated from the paper guide and a state where they are put in contact by the use of a simple mechanism.

A third object of the present invention is to cause, through a simple operation, the skew rollers to return to their normal position after the paper has been set.

The present invention is provided with a paper transport path made up of a reference surface with which one edge portion of paper is brought into abutment and a paper guide on which the surface of the paper is supported, a skew roller supported on a roller shaft, which is arranged at an angle with the transport direction of the paper, and resiliently urged toward the paper guide, a roller opening means for moving the skew roller away from the paper guide, a skew roller position control means having an abutment surface with which one end portion of the roller shaft is kept in abutment when the skew roller is in a position where it is in contact with the paper and a stopper edge with which the periphery of the roller shaft is kept in abutment when the skew roller is in an open position where it is separated from the paper and being urged toward the skew roller, and a release means to move the skew roller position control means away from the skew roller. Thus, it is adapted such that, when the paper is set into the apparatus, the skew roller is separated from the paper guide by the roller opening means, and at this time, the end portion of the roller shaft comes off the abutment surface of the skew roller position control means, and meanwhile, the skew roller position control means moves toward the skew roller and takes a position where it interferes with roller shaft, so that the roller shaft stopped by the stopper edge is prevented from returning to its original position. Hence, there is made an open gap between the skew roller and the paper guide even if the hand is taken off the roller opening means, so that setting of the paper is made easy. After the paper has been set, by operating the release means, the skew roller position control means is allowed to return toward its original position thereby releasing the skew roller with its roller shaft set free, and if then the hand is taken off the release means, the abutment surface of the skew roller position control means is put in abutment with the end face of the roller shaft, so that the skew roller becomes unrestricted in its movement.

DETAILED DESCRIPTION OF PREFERRED EMBODIMENTS

Figure 9:
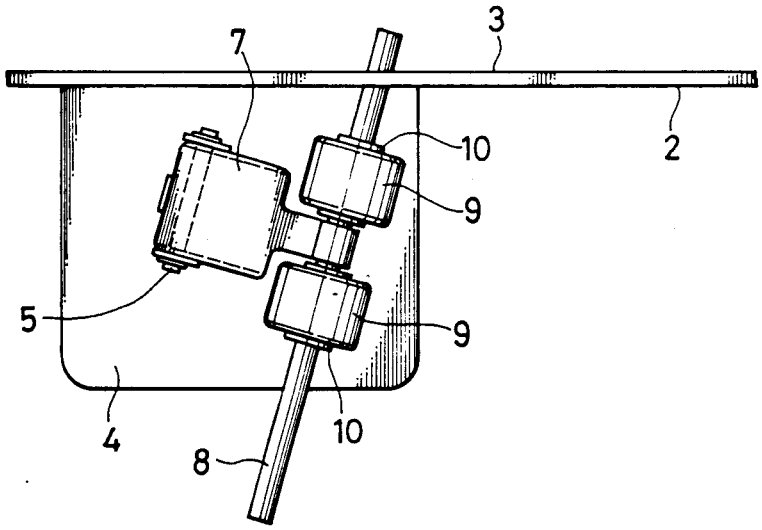
FIG. 9 is a plan view showing a prior art example.
Figure 10:
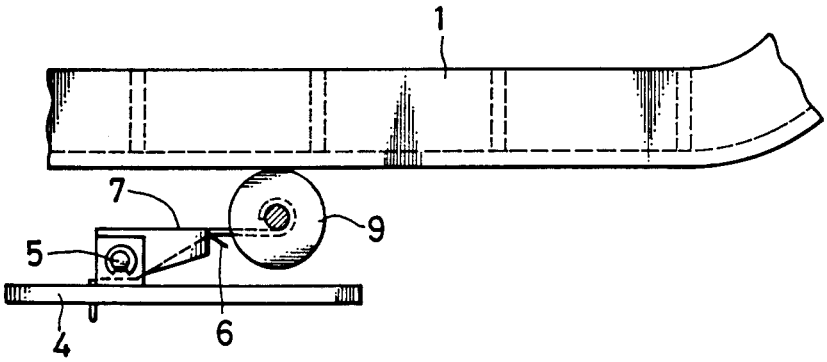
FIG. 10 is a side view of the same.

An embodiment of the present invention will be described with reference to FIG. 1 to FIG. 7. Like parts to those described in FIG. 9 and FIG. 10 will be denoted by like reference numerals and description thereof will be omitted.

Figure 1:
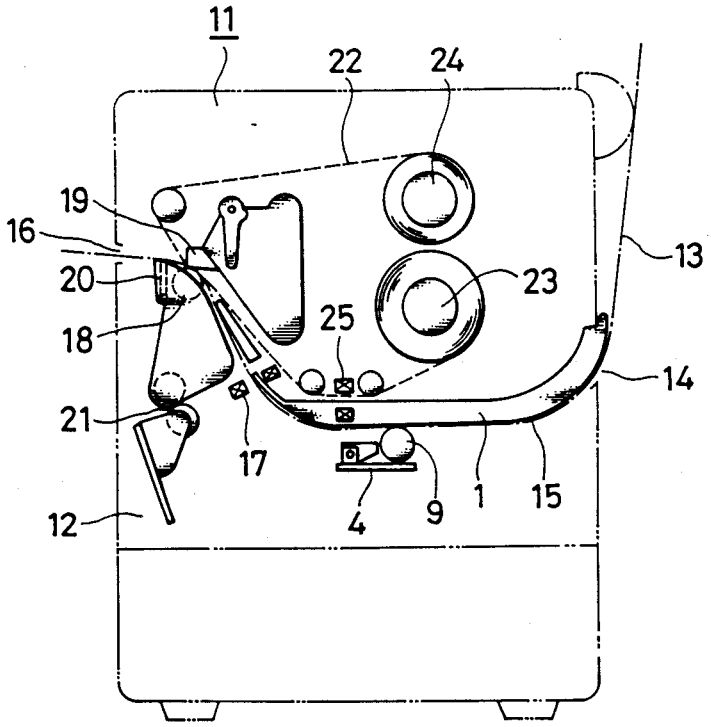
FIG. 1 is a longitudinal sectional side view schematically showing a structure of a label printer.
Figure 2:
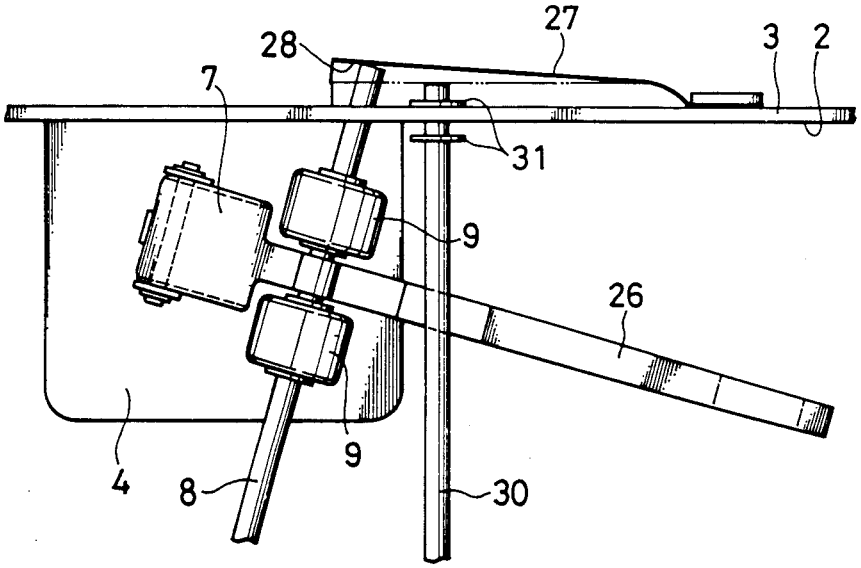
FIG. 2 is a plan view showing an embodiment of the present invention.

FIG. 1 shows an overall view of a label printer 11. At the back of a housing 12, there is made an insertion opening 14 for inserting paper 13 therethrough. A paper transport path 15 is formed of a paper guide 1. At the front of the housing 12, there is made a paper discharge opening 16.

The aforesaid paper 13 is that having ground paper in a long sheet form with rectangular labels stuck thereon at regular intervals. There are two modes of operation: one to issue the labels peeling them off the ground paper and the other to issue the labels as stuck on the ground paper.

Along the paper transport path 15, there are arranged a paper sensor 17, a platen 18, a thermal head 19, and a peeling plate 20, and below the peeling plate 20, there are provided a pair of ground paper feed rollers 21 for pulling the ground paper into the housing 12 when the labels are peeled off the same to be issued.

Also, there are provided a ribbon supply shaft 23 for retaining a printing ribbon 22 coiled into a roll and a ribbon take-up shaft 24 for retaining the printing ribbon 22 wound round. Between the ribbon supply shaft 23 and the ribbon take-up shaft 24, there is provided a ribbon sensor 25, whereby the printing ribbon 22 is aligned with its path so that it register with the paper 13 at the position between the platen 18 and the thermal head 19.

Below the paper guide 1, there is provided a mount 4 and a skew roller 9 is mounted on the mount 4 through a mounting plate 7. Further, there is provided a roller opening lever as a roller opening means with its one end fixed to the mounting plate 7. The other end of the roller opening lever 26 is prolonged to stick out in one direction.

The end portion of the roller shaft 8 projects from the side plate 3 through a slit (not shown) made in the side plate 3 and held in abutment with an abutment surface 28 of a guide spring 27 as a skew roller position control means. The guide spring 27 is fixed at its one end to the side plate 3 and held at its free end portion in abutment with the end portion of the roller shaft 8. Below the abutment surface 28 of the guide spring 27, there is a stopper edge 29 formed parallel to the paper guide 1.

Figure 6:
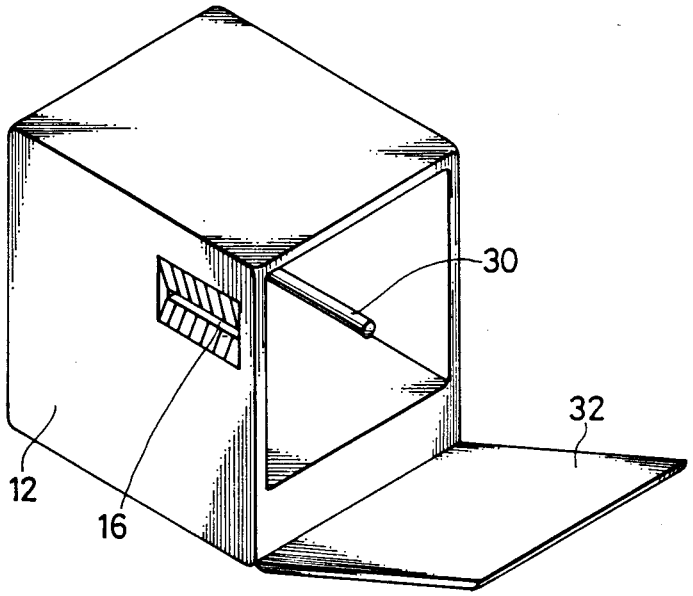
FIG. 6 is a perspective view showing more roughly a relation between a cover and a release bar.
Figure 7:
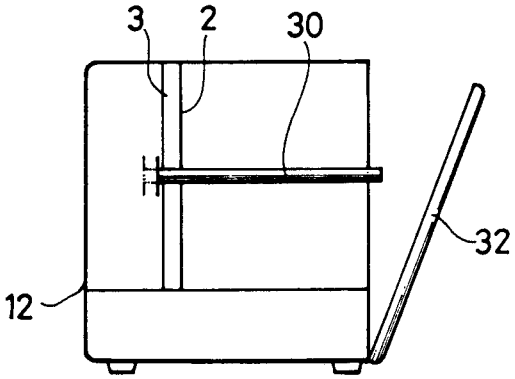
FIG. 7 is a longitudinal sectional front view of the same.

Further, there is provided a release bar 30 as a releasing means fitted to the side plate 3 for axial movement with its axis in the direction perpendicular to the reference surface 2. The release bar 30 is provided with two stop rings 31, located at both sides of the side plate 3, for controlling its movement. The other end of the release bar 30 is located, as schematically shown in FIG. 6 and FIG. 7, at a positon where it abuts against a cover 32 provided for the housing 12.

Figure 3:
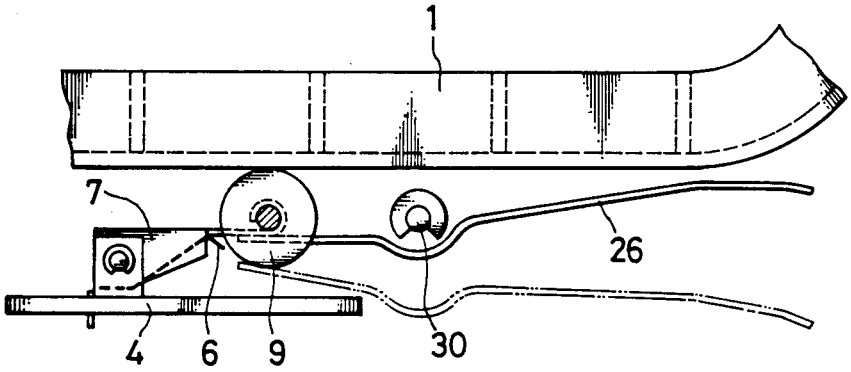
FIG. 3 is a side view of the same.
Figure 4:
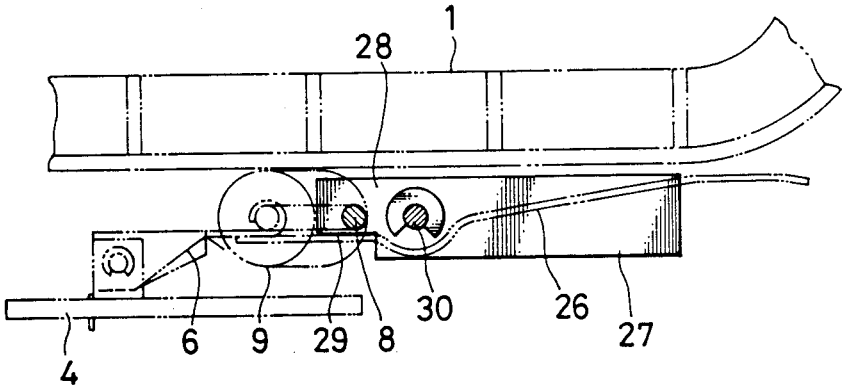
FIG. 4 is a side view showing relative position between a guide spring and a roller shaft when paper is transported.

With the described arrangement, in a normal paper feeding state, the skew rollers 9 are held in a free state to push the paper 13 as shown in FIG. 3 and FIG. 4 thereby serving its intended function for preventing skew movement of the paper 13.

When new paper 13 is to be set, the cover 32 is opened and the roller opening lever 26 is pressed down, whereby the roller shaft 8 holding the skew rollers 9 is also moved downward. While it moves down, the end portion of the roller shaft 8 descends sliding along the abutment surface 28 of the guide spring 27. When the distance of the descent reaches a predetermined value, the end portion of the roller shaft 8 comes off the abutment surface 28 and, hence, the guide spring 27 is moved by its own resilience toward the side of the skew rollers 9 and takes a position above the roller shaft 8 where it interferes with the roller shaft 8.

Figure 5:
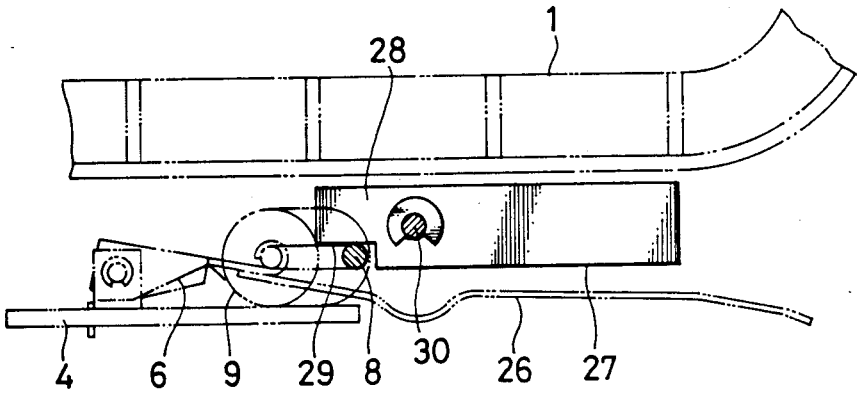
FIG. 5 is a side view showing relative position between the guide spring and the roller shaft in an open state.

In this state, if the hand is taken off the roller opening lever 26 to set the skew rollers 9 free, the mounting plate 7 rotates upward by the force of the push-up spring 6, whereby the skew rollers 9 are moved upward. However, since the roller shaft 8 supporting the skew rollers 9 is brought into abutment with the stopper edge 29 of the guide spring 27, it is prevented from rising further as shown in FIG. 5, and thereby, a state where there is formed an open gap between the skew rollers 9 and the paper guide 1 is brought about. Thus, setting of the paper 13 becomes easy with both hands free, and it also becomes easy to position the paper 13 at the position where it is in abutment with the reference surface 2.

When setting of the paper 13 is thus finished, the release lever 30 is pushed in. Thereby, the guide spring 27 is pushed to move outward to reach the position at the end portion of the roller shaft 8, and then, the roller shaft 8 which has been restricted in movement by the stopper edge 29 is set free and allowed to rise by the force of the push-up spring 6, whereby the paper 13 comes to be pressed on. Then, even if the push on the release bar 30 is removed, the skew rollers 9 is not interfered in its movement only having the end portion of the roller shaft 30 put into abutment with the abutment surface 28 of the guide spring 27.

When it is forgotten to operate the release bar 30, since the skew rollers 9 is then left separated from the paper guide 1, there is a risk of occurrence of a failure in transporting the paper 13. However, by shutting the cover 32 provided on the housing 12, the release bar 30 is pushed in and, thereby, without intentionally operating the release bar 30, the condition of the skew rollers 9 kept opened by the guide spring 27 is canceled.

Figure 8:
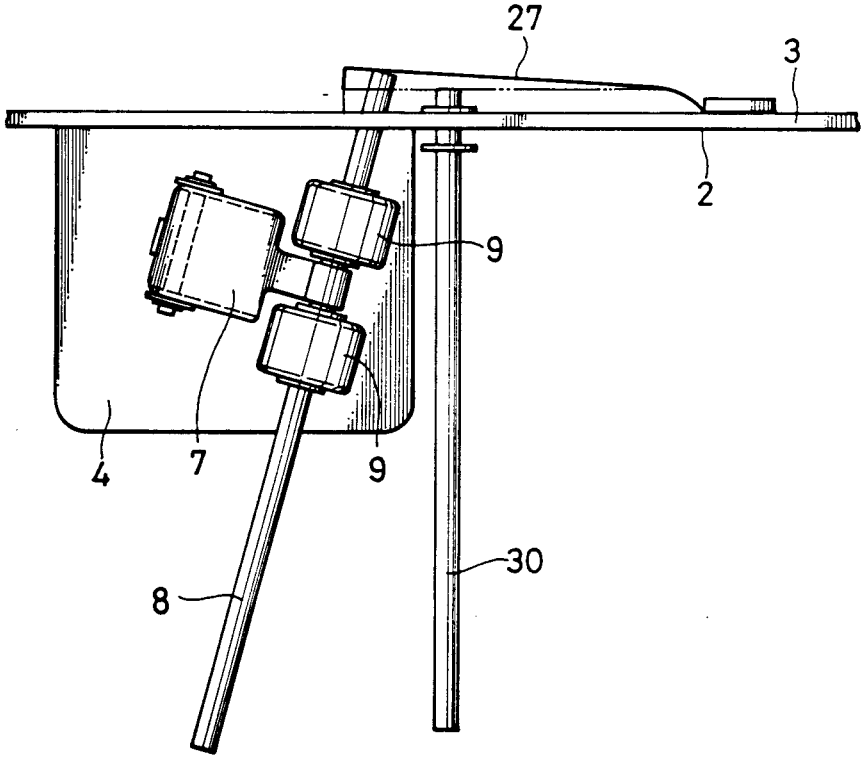
FIG. 8 is a plan view showing a variation of the embodiment.

FIG. 8 shows a variation of the present embodiment with the roller opening lever 26 omitted therefrom. More particularly, one end of the roller shaft 8 is prolonged so as to be gripped by hand and used as a roller opening means.

What is claimed is:

1. An apparatus for transporting paper comprising a paper transport path made up of a reference surface with which one edge portion of paper is brought into abutment and a paper guide on which the surface of the paper is supported, a skew roller supported on a roller shaft, which is arranged at an angle with the transport direction of the paper, and resiliently urged toward said paper guide, roller opening means for moving said skew roller away from said paper guide, skew roller position control means having an abutment surface with which one end portion of said roller shaft is brought into abutment when the skew roller takes a position to be in contact with the paper and a stopper edge with which the periphery of the roller shaft is brought into abutment when said skew roller takes and open position to be away from the paper and being urged toward said skew roller, and release means to move the skew roller position control means away from said skew roller.

2. An apparatus for transporting paper according to claim 1, wherein said roller shaft is prolonged so that a portion of said roller shaft is adapted to serve as said roller opening means.

3. An apparatus for transporting paper according to claim 1, whererin said release means is formed of a release bar, one end of said release bar being held in abutment with said skew roller position control means and the other end of said release bar being adapted to come into abutment with the interior surface of a cover capable of being opened.

* * * * *